United States Patent [19]

Doudet

[11] 4,386,513

[45] Jun. 7, 1983

[54] METHOD OF PRODUCTION OF METAL WIRES

[75] Inventor: Michel Doudet, Epone, France

[73] Assignee: SECIM, Courbevoie, France

[21] Appl. No.: 231,830

[22] Filed: Feb. 5, 1981

[30] Foreign Application Priority Data

Feb. 12, 1980 [FR] France ..... 80 03089

[51] Int. Cl.[3] ..... B21C 1/20; B21C 35/02

[52] U.S. Cl. ..... 72/256; 72/273.5; 72/257; 72/261; 72/278; 72/289; 72/378

[58] Field of Search ..... 72/205, 206, 253.1, 72/256, 257, 261, 378, 183, 289, 278, 273.5

[56] References Cited

U.S. PATENT DOCUMENTS

| | | | |
|---|---|---|---|
| 2,092,188 | 9/1937 | Simons | 72/378 |
| 2,720,310 | 10/1955 | Yack et al. | 72/261 |
| 3,226,948 | 12/1940 | Simons | 72/205 |
| 3,293,899 | 12/1966 | Terras | 72/378 |

FOREIGN PATENT DOCUMENTS

| | | | |
|---|---|---|---|
| 457931 | 3/1928 | Fed. Rep. of Germany | 72/256 |
| 562295 | 10/1932 | Fed. Rep. of Germany | 72/257 |
| 48-5416 | 2/1973 | Japan | 72/257 |

*Primary Examiner*—Lowell A. Larson

*Attorney, Agent, or Firm*—Pollock, Vande Sande & Priddy

[57] ABSTRACT

A method of reducing the cross-sectional area of one or more extruded wires as a combined effect of drawing and rolling, by passing the wires through reduction rollers driven at a peripheral speed which exceeds the greatest extrusion speed of any of the wires, thereby avoiding the formation of fins due to the passage of excess material between the rollers. Use of this method makes it unnecessary to track the rotation speed of the rollers with variations in the extrusion speeds.

2 Claims, 4 Drawing Figures

1
2
3
4
5
6
61
62
63
63
17
71
72
73
74
II
II 60
63
63
a
b
A
B
e1
e2

METHOD OF PRODUCTION OF METAL WIRES

FIELD OF THE INVENTION

The object of the invention is an improved method of production of metal wires by the combined action of drawing and rolling and is applied more paticularly to the production of wires obtained by extrusion from one and the same metal ingot.

BACKGROUND

From the production of metal wires and more especially of wires from non-ferrous metals such as copper, aluminium or brass, an extrusion press is generally employed.

In the method known as direct extrusion a hot metal ingot or billet is placed inside a fixed container the end of which is equipped with a die of the required diameter. Through the other end of the container is introduced a rammer which compels the metal of the billet to pass through the die to form the wire.

In the method known as inverse extrusion the rammer consists of a fixed tubular column carrying the die at the end of it. The ingot is placed in a container against which bears a movable crosshead actuated by a jack which causes threading of the container over the rammer with formation of the wire.

In both cases one is restricted in the diameter of the wire obtained and it is difficult to get below a diameter of 7 to 8 mm, depending upon the power of the press.

In order to reduce the diameter of the wire further, it may be subjected to rolling by passing between a pair of rollers which roll practically one against the other, each bearing a groove of cross-section equal to half the cross-section of the wire which it is desired to obtain.

If the wire leaves the die at a velocity $V_1$ with an area of cross-section $S_1$ and the area of passage between the rollers is $S_2$ the wire passes between the rollers at a velocity of transit $V_2$ which is connected with $V_1$ in a ratio which is the inverse of the ratio between the corresponding areas of cross-section. That is, one has:

$$\frac{V_2}{V_1} = \frac{S_1}{S_2}$$

Consequently the rollers for reduction in area must be driven in rotation so that their peripheral velocity $V_3$ in the groove is substantially equal to the velocity of transit $V_2$ which has just been defined.

The Applicant Company has already proposed in the French Pat. No. 2.360.359 filed on Aug. 5, 1976, to subject the wire to drawing after leaving the die, this drawing being caused by rollers for reduction in area. With this object the latter must be driven at a peripheral velocity $V_3$ higher than $V_2$. In that way the area of the wire is reduced by a combined effect of traction and rolling. However, the velocity of leaving the die may vary and this is in particular the case when the extrusion of a number of wires is being carried out simultaneously from one and the same ingot by means of a number of dies side by side.

That is, it has already been observed that in the extrusion of brasses in two jets the leaving velocities of the products are generally different for numerous reasons the main ones of which are:

- a geometric difference in origin and a different deformation of the dies,

- a different clogging of the two dies,
- and above all a heterogeneity of temperature of the billet in which the plane of symmetry of the distribution of the temperatures across a cross-section has no reason in general to coincide with the plane of symmetry perpendicular to the axis common to the two dies. This difference in velocity presents a disadvantage especially in the reeling of the wires on reelers located after the die, the speed of rotation of which must be regulated as a function of the velocity of transit of the wire. Hitherto it has been observed, however, that the various parameters of extrusion were stabilized at the time of an extrusion series and that the difference in velocity was substantially repetitive from one extrusion to the next. Hence a substantially constant correction may be made of the speeds of rotation of the reelers which receive the products. Thus in practice a correction of velocity may be carried out, of the order of more or less 15% about the mean velocity.

But when the area of cross-section is reduced between two rollers this difference in velocity may have another disadvantage.

That is, in the event of increase in the velocity $V_1$ of leaving the die there is produced upstream of the rollers for reduction in area, an influx of material which may lead to the formation of fins by the passing of the excess metal between the rollers on opposite sides of the wire. Hence one would be obliged if one wanted always to produce a drawing of the wire, to subordinate the speed of rotation of the rollers to the velocity $V_1$ of leaving the die.

SUMMARY OF THE INVENTION

The object of the invention is improvements which enable one to be sure that the wire is always subjected to a force of drawing without its being necessary that the speed of rotation of the rollers follow permanently the variations in the velocity of leaving the die.

But the invention is applicable quite specially to the case where two or more wires are being produced by extrusion from one and the same ingot. That is, in this case the variations in the velocity of extrusion and consequently the disadvantages indicated are greater and it would be necessary to subordinate each of the pairs of rollers separately to the speed of leaving of the corresponding wire.

The invention enables this disadvantage to be avoided and especially the two pairs of drawing rollers to be driven simultaneously at the same speed.

In accordance with the invention the rollers for reduction in area are given a speed of rotation high enough for the wire, whatever the variations in the velocity of leaving the die, to be subjected at any time to a force of traction sufficient to cause a reduction in the area of cross-section of the wire down to the area of passage between the rollers with a crushing which is just that necessary to determine the draw upon wire.

For the simultaneous production of at least two wires a, b, by extrusion from one and the same metal ingot in at least two dies side by side at velocities $V_1a$, $V_1b$, each wire passes in accordance with the invention between two rollers for reduction in area, which are driven in rotation at one and the same speed so that their peripheral velocity is kept permanently at a value higher than the highest of the two velocities of transit $V_2a$ and $V_2b$ between the rollers whatever the variations in the velocities of extrusion $V_1a$ and $V_1b$.

When the wire is being driven by the two rollers, its area of cross-section $S_2$ obviously depends upon the depths of the grooves. It has been pointed out that the velocity of transit $V_2$ is determined solely by the ratio between the areas of cross-section and the velocity of transit $V_1$. Consequently, if the rollers are given a peripheral velocity $V_3$ higher than $V_2$ a traction is effected which causes a contraction which has the effect of reducing the area of cross-section of the wire upstream of the rollers and consequently of diminishing the rolling effect, obivously without modifying the area $S_2$ at leaving, which depends only upon the rollers.

If the peripheral velocity of the rollers is further increased, the effect of traction and hence of contraction is going to increase at the expense of the rolling effect, but the latter cannot totally disappear because a minimum crushing is necessary for the wire to be drawn along by the rollers. Consequently even a large increase in the peripheral velocity of the rollers will have no influence either upon the area $S_2$ at leaving or upon the velocity of transit $V_2$ and will show up solely as a skidding on the wire and possibly wearing of the rollers. This disadvantage is not important because it is easy to change the rollers; on the other hand it has been found that the fact of giving the rollers an excess speed enabled one advantageously to take no longer into consideration the variations in the velocity of extrusion $V_1$. Now, in any case the velocity of extrusion is limited to the nominal velocity which depends upon the speed of sinking the rammer into the container. Consequently, if in accordance with the invention the rollers for reduction in area are driven at a speed of rotation such that the peripheral velocity in the groove is higher than the maximum velocity of transit $V_{2\,max}$ which corresponds with the maximum velocity $V_{1\,max}$ of leaving the die, one will at all events avoid the formation of fins at the sides which could result from an increase in the velocity $V_1$ bringing an influx of material upstream of the rollers. In short, if $V_1$ increases, $V_2$ must increase in the same proportion, but if the rollers are driven at an excess speed this will always be higher than the maximum velocity $V_{2\,max}$ and one will be sure that at all events the rollers will cause a draw which diminishes the rolling effect.

But the invention is particularly interesting in the case of an extrusion in a number of jets, as will be described below by referring to the attached Figures.

DETAILED DESCRIPTION OF ILLUSTRATED EMBODIMENT

Figure 1:
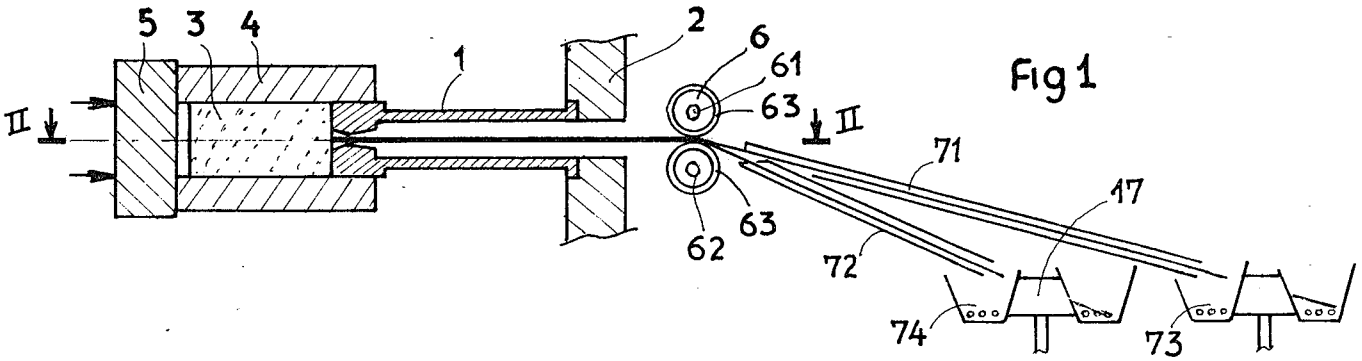
FIG. 1 is a diagrammatic view of a press for extrusion of two wires, in section through a vertical plane passing through one axis of extrusion.
Figure 2:
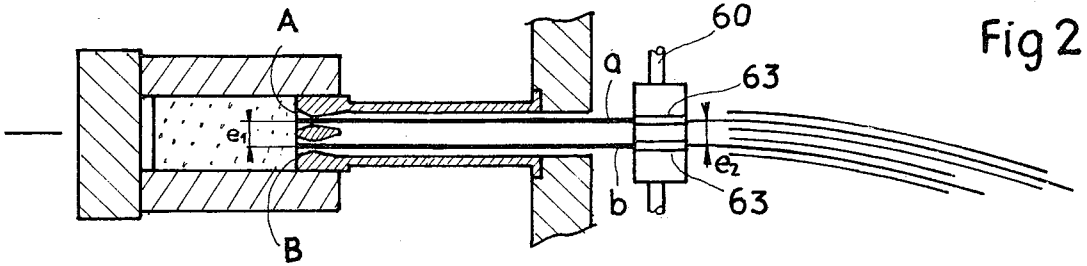
FIG. 2 is a plan in section through the plane passing through the axes of extrusion along II—II in FIG. 1.

In FIGS. 1 and 2 is represented very diagrammatically a portion of a press for extrusion by the inverse method, which includes two dies A and B mounted at the end of a tubular rammer 1 which bears against a fixed crossbeam 2. The billet 3 of metal to be extruded is placed inside a container 4 closed at the opposite end from the rammer by a movable crosshead 5 which is moved towards the fixed crossbeam 2 under the action of a main jack driving the container 4 which is threaded over the rammer 1, which causes the extrusion of two wires a–b through the dies A and B.

On leaving the press at the other side of the fixed crossbeam 2, each wire passes between two rollers 6 which enable the area of cross-section to be reduced by the combined effect of rolling and drawing. The process of the reduction in diameter of a wire (a) or (b) is represented in detail in FIG. 3.

On leaving the rollers the two wires a and b are directed respectively by channels 71, 72 towards the two trough reelers 73, 74 driven in rotation about a vertical axis.

The centredistance e2 between the grooves in the rollers is equal to the centredistance e1 between the dies A and B so that the axis of each die, the axis of the wire leaving it and the axis of the corresponding groove coincide.

Taking into account the dimensions of the presses and especially the length of the rammer, the distance between the die and the rollers may be of the order of several meters even if the rollers are placed as near as possible to the press in order to reduce the bulk of the device.

Thanks to the invention the grooves through which the two wires a and b pass may have the same peripheral velocity and consequently the rollers in which they are cut and which revolve always at the same speed may be keyed in pairs onto two shafts 61 and 62 driven in rotation at the same speed and in opposite directions by a mechanical device easy to conceive of and not shown in the drawings. This is why as shown in FIG. 2 the grooves for passing the two wires a and b will be cut in only one pair of rollers keyed onto the shafts 61 and 62, each roller having two parallel grooves separated by a distance e2.

Figure 4:
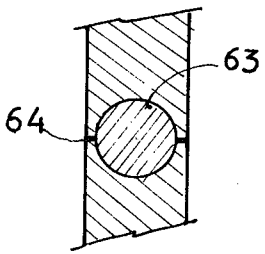
FIG. 4 is a section along IV—IV in FIG. 3, of the passing of the wire between two rollers.
Figure 3:
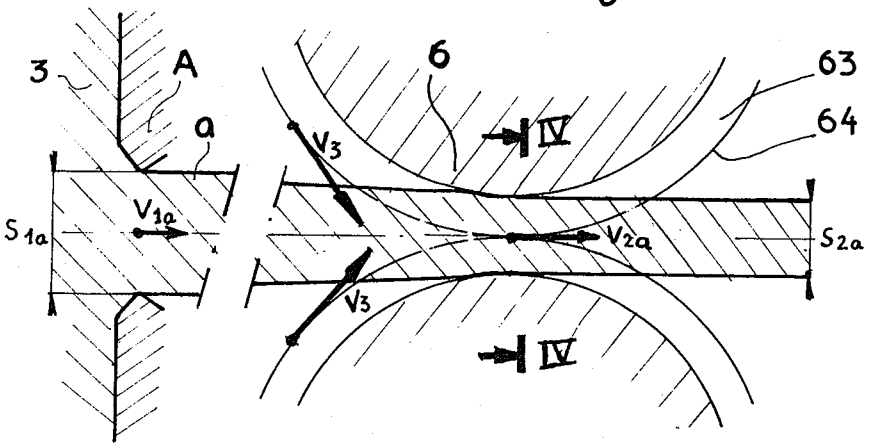
FIG. 3 represents on an enlarged scale the process of reduction of a wire (a) in diameter.

In FIGS. 3 and 4 there is represented diagrammatically the extrusion of one wire (a). The metal from the ingot 3 is compelled to pass through the die A in order to form the wire (a) of cross-sectional area $S_1a$ which leaves the die at velocity $V_1a$. On leaving the press the wire passes between the two rollers 6 which are each equipped with a groove 63 and bear against one another by circular tracks 64 which are tangents to one another in the plane parallel with the axis of the rollers and passing through the axis of the wire. Hence the wire (a) undergoes at least partial rolling in passing between the rollers and leaves with a cross-sectional area $S_2a$ which corresponds with the area imposed by the grooves 63 and 64 and at a velocity $V_2a$ such that:

$$\frac{V_{2a}}{V_{1a}} = \frac{S_{1a}}{V_{2a}}$$

However, the two rollers 6 are driven in rotation at a speed such that their peripheral velocity $V_3$ in the groove is higher than $V_2a$ so as to cause drawing and a reduction in area of cross-section by contraction which diminishes the rolling effect.

As has already been pointed out in the case of one wire the peripheral velocity $V_3$ of the rollers 6 is very much higher than $V_2$, the difference being such that whatever $V_1$ may be, the rolling effect is always reduced to the minimum necessary to cause drawing of the wire by the rollers. Moreover this drawing effect is restricted because if the area of cross-section of the wire were reduced too much upstream of the rollers it could no longer be driven by the latter.

In the case of the extrusion of two wires the sum of the velocities of extrusion $V_1a+V_1b$ is constant and corresponds with the velocity of movement of the movable crosshead.

Consequently in the limit, even if one velocity of extrusion became nearly nil, one would still be sure of achieving the necessary drawing by driving the two pairs of rollers at a peripheral velocity higher than the velocity $V_2$ corresponding with this constant.

However, it has been observed that with a given machine the velocities of extrusion in the two dies side by side does not vary more than x% above or below the mean velocity. Consequently, knowing the mean velocity of extrusion $$V_1m = \frac{V_1a + V_1b}{2},$$

and having determined x by observation of the operation of the press, one will be sure of obtaining a correct result by giving the rollers a peripheral velocity $V_3$ which is higher than $$\left(1 + \frac{x}{100}\right) V_2m,$$

$V_2m$ being the velocity of transit which corresponds with $V_1m$, that is to say: $V_2m=V_1m.S_1/S_2$.

Furthermore it is known that in practice the velocities of extrusion do not vary more than 15% about the mean velocity. Consequently one will generally choose a peripheral velocity higher than 1.15 $V_2m$.

But in order to be more sure of obtaining a satisfactory result the rollers may be driven at a speed still higher, corresponding, for example, with $1.5V_2m$ or even $2V_2m$. In this case, whatever the variations in the velocity of extrusion, the two wires will have perfectly stable areas of cross-section on leaving and the influx of material upstream of the rollers and the formation of fins on opposite sides of the wire between the bearing tracks 64 will always be avoided.

Of course the invention is not restricted to the details of the embodiment which has just been described, and in particular to the extrusion of one or two wires.

The arrangements which have just been described might in short form the object of variants, especially for the obtaining of more than two wires.

I claim:

1. A method of producing metal wire, comprising the steps of (a) extruding said wire from a die having a cross-section $S_1$ at a mean extrusion velocity $V_1m$, followed by (b) reducing the cross-section of said extruded wire as a combined effect of drawing and rolling by passing said wire between two rollers having a passage of cross-section $S_2<S_1$, to which corresponds a mean exit velocity on the part of the wire of $$V_2m = \frac{S_1}{S_2} V_1m,$$

said rollers being driven at a peripheral speed $V_3$ greater than $1.15V_2m$ and maximally $2V_2m$.

2. A method of simultaneously producing at least two wires (a, b), comprising the steps of (a) extruding said wires from the same metal billet in at least two juxtaposed dies of section $S_1$, said wires (a, b) leaving the corresponding die at extrusion speeds of $V_1a$ and $V_1b$, respectively;

(b) passing each of said wires through a passage between a pair of section reduction rollers having a cross section up to a value of $S_2<S_1$, said wires being drawn between said rollers at a drawing speed of $V_2a$ and $V_2b$, respectively, proportional to their extrusion speeds of $V_1a$ and $V_1b$, respectively, from the corresponding die, in the ratio of the passage cross sections;

(c) determining, by observation of the extrusion operation, the maximum possible difference, in terms of x%, between the respective extrusion speeds $V_1a$ and $V_1b$ with respect to a mean speed $V_1m$; and (d) rotatably driving said section reduction rollers of said two wires at an identical peripheral speed $V_3$, the latter speed being greater than $$\left(1 + \frac{x}{100}\right) V_2m, \text{ wherein } V_2m = \frac{S_1}{S_2} V_1m.$$

* * * * *